US011918876B1

(12) United States Patent
Apodaca

(10) Patent No.: US 11,918,876 B1
(45) Date of Patent: Mar. 5, 2024

(54) GRAPPLING DUMMY WITH RESISTANCE

(71) Applicant: David Apodaca, Oracle, AZ (US)

(72) Inventor: David Apodaca, Oracle, AZ (US)

( * ) Notice: Subject to any disclaimer, the term of this patent is extended or adjusted under 35 U.S.C. 154(b) by 0 days.

(21) Appl. No.: 18/372,457

(22) Filed: Sep. 25, 2023

(51) Int. Cl.
*A63B 69/34* (2006.01)

(52) U.S. Cl.
CPC ..... *A63B 69/34* (2013.01); *A63B 2244/108* (2013.01)

(58) Field of Classification Search
CPC .. A63B 69/34; A63B 69/215; A63B 2244/108
See application file for complete search history.

(56) References Cited

U.S. PATENT DOCUMENTS 2,909,370 A * 10/1959 Fortney ..... A63B 69/215 446/373
3,804,406 A * 4/1974 Viscione ..... A63B 69/215 482/4
3,861,676 A * 1/1975 Paul ..... A63B 69/215 482/90
3,888,481 A * 6/1975 Adams, Jr. ..... A63B 69/00 434/247
7,828,701 B1 * 11/2010 Chen ..... A63B 69/22 482/90
7,998,035 B2 * 8/2011 Chen ..... A63B 69/224 482/90
9,050,514 B1 * 6/2015 Mirza ..... A63B 69/34
9,789,375 B2 * 10/2017 Salerno ..... A63B 69/22
9,878,197 B2 * 1/2018 Mayes ..... A63B 21/4027
10,561,919 B1 * 2/2020 Huff ..... A63B 69/34
2008/0015093 A1 * 1/2008 Helton ..... A63B 69/34 482/83
2011/0256990 A1 * 10/2011 Machado ..... A63B 69/34 482/83
2014/0155228 A1 * 6/2014 Salerno ..... A63B 71/023 482/84
2014/0378281 A1 * 12/2014 Mazi ..... A63B 24/0021 482/83
2016/0074729 A1 * 3/2016 DeLaRosa ..... A63B 69/215 482/83
2018/0233068 A1 * 8/2018 Kraus ..... G09B 19/003
2019/0255411 A1 * 8/2019 He ..... A63B 71/0622
2020/0122012 A1 * 4/2020 Wagner ..... A63B 69/215
2021/0060381 A1 * 3/2021 Lalaoua ..... A63B 21/4035
2021/0379459 A1 * 12/2021 Czarnecki ..... A63B 69/215
2021/0402277 A1 * 12/2021 Tartuffe ..... A63B 69/20
2022/0362649 A1 * 11/2022 Lee ..... A63B 69/215

FOREIGN PATENT DOCUMENTS

CN 110115828 A * 8/2019 ..... A61M 21/00

OTHER PUBLICATIONS

Apodaca, David, "Statement Concerning Prior Experimental Use", Oct. 5, 2023, pp. 1-3; Exhibit pp. 1-4.

* cited by examiner

*Primary Examiner* — Nyca T Nguyen
(74) *Attorney, Agent, or Firm* — HAYES SOLOWAY P.C.

(57) ABSTRACT

A grappling dummy apparatus includes a rigid frame sized and shaped to resemble a human body having a head, torso, arms, and legs. A brace piece is connected to the rigid frame and extends from a rear portion of the rigid frame. At least one spring is connected to two adjacent portions of the rigid frame. The portions of the rigid frame connected by the at least one spring are biasably movable.

18 Claims, 10 Drawing Sheets

Method Of Making A Grappling Dummy

700

GRAPPLING DUMMY WITH RESISTANCE

FIELD OF THE DISCLOSURE

The present disclosure is generally related to grappling dummies and more particularly is related to grappling dummies for solo training.

BACKGROUND OF THE DISCLOSURE

Practitioners of physical activities such as wrestling, martial arts, paramedic and fire rescue, and the like require many hours of training in order to perfect the physical forms and movements used within those activities. Many types of training involve practicing the forms and movements under conditions which resemble realistic scenarios, including using a human sparring partner or training dummy. Human sparring partners can be non-ideal for training in certain circumstances; humans may become tired, injured, bored, or engaged in other activities. However, training dummies or grappling dummies also have limitations. They do not approximate human movement, strength, and stance very well. They require a training partner to hold, manipulate, and reset them. And they do not exert force in return as a human sparring partner does. This causes training sessions with dummies to be less than fully realistic, and may not prepare the practitioner for a human response when engaging with a real person.

Thus, a heretofore unaddressed need exists in the industry to address the aforementioned deficiencies and inadequacies.

SUMMARY OF THE DISCLOSURE

Embodiments of the present disclosure provide a grappling dummy apparatus. Briefly described, in architecture, one embodiment of the apparatus, among others, can be implemented as follows. A grappling dummy apparatus includes a rigid frame sized and shaped to resemble a human body having a head, torso, arms, and legs. A brace piece is connected to the rigid frame and extends from a rear portion of the rigid frame. At least one spring is connected to two adjacent portions of the rigid frame. The portions of the rigid frame connected by the at least one spring are biasably movable.

The present disclosure can also be viewed as providing methods of making a grappling dummy. In this regard, one embodiment of such a method, among others, can be broadly summarized by the following steps: providing a rigid frame sized and shaped to resemble a human body having a head, torso, arms, and legs; connecting a brace piece to the rigid frame, the brace piece extending from a rear portion of the rigid frame; connecting at least one spring between two adjacent portions of the rigid frame, thereby causing the portions of the rigid frame connected by the at least one spring to be biasably movable.

Other systems, methods, features, and advantages of the present disclosure will be or become apparent to one with skill in the art upon examination of the following drawings and detailed description. It is intended that all such additional systems, methods, features, and advantages be included within this description, be within the scope of the present disclosure, and be protected by the accompanying claims.

BRIEF DESCRIPTION OF THE DRAWINGS

Many aspects of the disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views.

DETAILED DESCRIPTION

Figure 1:
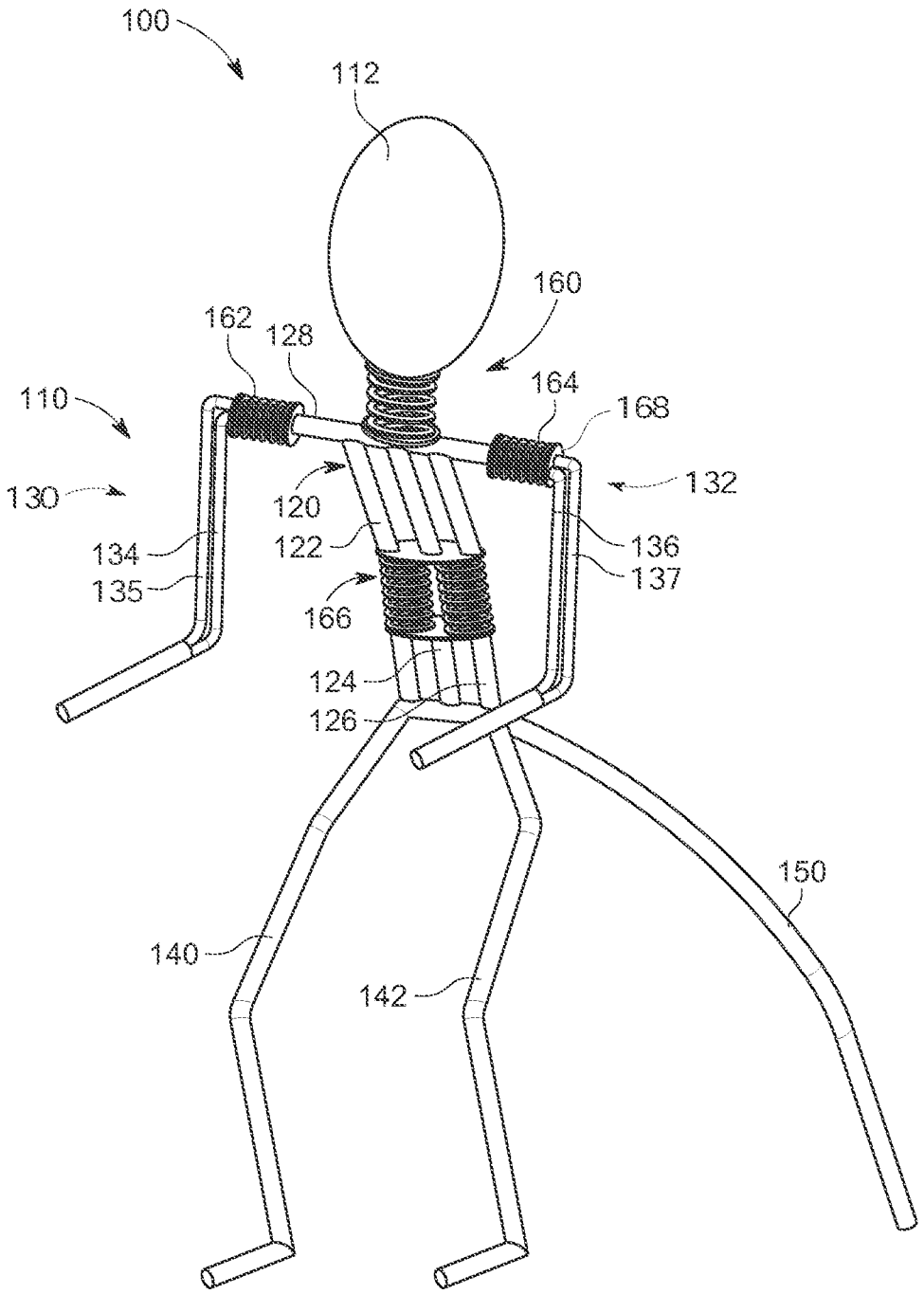
FIG. 1 is a diagrammatic illustration of a grappling dummy apparatus, in accordance with a first exemplary embodiment of the present disclosure.

FIG. 1 is a diagrammatic illustration of a grappling dummy apparatus 100, in accordance with a first exemplary embodiment of the present disclosure. The grappling dummy apparatus (hereinafter "grappling dummy") 100 includes a rigid frame 110 sized and shaped to resemble a human body having a head 112, torso 120, arms 130, 132, and legs 140, 142. A brace piece 150 is connected to the rigid frame 110 and extends from a rear portion of the rigid frame 110. At least one spring 160-166 is connected to two adjacent portions of the rigid frame 110. The portions of the rigid frame 110 connected by the at least one spring 160-166 are biasably movable.

FIG. 1 shows the grappling dummy with an exposed (visible) rigid frame 110. This is for clarity of illustration. As will be described below, in some examples, the rigid frame 110 may be partially or fully covered by an exterior layer which may provide insulation against the rigid frame 110. In other examples, the rigid frame 110 may substantially form the shape and appearance of the grappling dummy 100 without the need for an additional exterior aesthetic layer. This may include a rigid frame 110 which is a large, human-shaped housing but does not include an interior rigid structure. This may also include a rigid frame 110 which is like the rigid frame 110 shown in FIG. 1 and may include a minimal soft exterior layer which does not alter the appearance of the rigid frame 110 from a wire frame aesthetic. In the example shown in FIG. 1, the rigid frame 110 forms the underlying structure of the grappling dummy 100 and may accept an exterior layer surrounding the rigid frame 110 when in use. However, this is not meant to be limiting, but is offered as an example.

The rigid frame 110 may be sized and shaped to resemble a human body. In one example, this may include a plurality of features of the human body, such as a head 112, torso 120, arms 130, 132, and/or legs 140, 142. This may allow a practitioner using the grappling dummy 100 to practice the practitioner's forms and moves on a more realistic, lifelike object. In one example, only a portion of these features may be included in the shape of the rigid frame 110. This may allow the practitioner to focus on particular moves or forms without the interference of certain features. For instance, a practitioner focusing on training leg-based moves may find it helpful if the grappling dummy 100 does not have arms 130, 132 during a portion of the training. In one example, certain features may be removable and replaceable, depending on how the practitioner intends to use the grappling dummy. For instance, the practitioner may remove the head 112 while performing certain training exercises, but return the head 112 to its position for more advanced training exercises once a move has been mastered at a basic level.

The rigid frame 110 may have any suitable human body-like size and shape, including children, adults, males, females, large people, small people, and the like. The size and length of any particular human feature may be any suitable size and length. The rigid frame 110 may be formed from any suitable rigid material. In one example, this may include materials such as metals, wood, dense and rigid plastics, rubber, high density foam, and the like. In one particular example, the rigid frame 110 may be constructed from steel bar, such as ½-inch steel rebar. In this example, the steel may be formed as a human skeleton to provide shape and structure for the human features 112, 120, 130, 132, 140, 142. In another particular example, the rigid frame 110 may be constructed from a metal such as titanium. The pieces of the rigid frame 110 may be joined by any suitable method, including welding, casting, milling, 3-D printing, gluing, fastening, and the like.

The human features of the rigid frame 110 may include a head 112, torso 120, arms 130, 132, and legs 140, 142. In the example shown in FIG. 1, the rigid frame 110 forms a rudimentary stick figure more or less approximating the appearance of these features. In another example, the rigid frame 110 may form a skeleton similar to a human skeleton in appearance and operation. In another example, the rigid frame 110 may form the human features 112-142 in aesthetic appearance without the need for additional covering or application. In one example, the human features of the rigid frame 110 may connect with one another in a way resembling a human body. For instance, the head 112 may be on top of and connected with the torso 120. The arms 130, 132 may include a left arm 130 and right arm 132 extending away from the torso 120. In one example, a shoulder piece 128 may connect the arms 130, 132 with the head 112 and torso 120. In one example, each arm 130, 132 may include multiple pieces, such as bicep pieces, forearm pieces, and the like. In the example shown in FIG. 1, the "bicep" portion of each arm 130, 132 is comprised of two pieces 134, 135, 136, 137, respectively, which may improve the stability of the arms 130, 132 during operation. The bicep pieces 134, 135, 136, 137 may attach to one another at any suitable point along the arm, for example, at the "elbow," at the "forearm," or at any other point. The bicep pieces 134, 135, 136, 137 may be positioned side by side, in front and behind one another, or at any location relative to one another, depending on use. It should be understood that any suitable number of pieces may be used, including as few as one piece, and as many as several pieces. For ease of illustration, FIGS. 4 and 6A-6D will show a single piece forming each arm 130, 132. The legs 140, 142 may include a left leg 140 and right leg 142 and may connect below the torso 120. The legs 140, 142 may end in a portion resembling feet, and may be shaped to place the grappling dummy 100 in a stance or position. It should be understood within the scope of this disclosure that any body part may be formed with and from any number and arrangement of pieces, including the singular pieces illustrated within this Figure, as well as configurations of multiple pieces to form the body parts of the rigid frame 110.

The torso 120 may include one or more pieces 122, 124, 126 to provide form and strength for the torso 120. In the example shown in FIG. 1, three pieces 122, 124, 126 extend downward from the shoulder piece 128, connecting with the legs 140, 142. However, any suitable number and shape of pieces are contemplated within the scope of this disclosure.

A brace piece 150 is connected to the rigid frame 110 and extends from a rear portion of the rigid frame 110. The brace piece 150 may resemble a tail in appearance, extending from the rear end of the grappling dummy 100 to the lower surface upon which the grappling dummy 100 is positioned. In one example, the brace piece 150 may be a straight piece. In another example, the brace piece 150 may be bent, curved, or arcuate in a concave or convex direction. In the particular example shown in FIG. 1, the brace piece 150 has a downward sloping arcuate shape resembling an upside-down bowl. The brace piece 150 may end in a point at a level of the legs 140, 142 portion of the rigid frame 110. This may provide a third point of stability for the grappling dummy 100, allowing the grappling dummy 100 to stand on its own and remain standing during training. The brace piece 150 may be formed from any suitable material, including the materials discussed with reference to the rigid frame 110 above. The brace piece 150 may be connected to the rigid frame 110 by any suitable method, including the methods discussed relative to the rigid frame 110 above. In one example, the brace piece 150 may be removably connected to the rigid frame 110 by way of removable fasteners such as screws, bolts, button locks, and the like. In another example, the brace piece 150 may be repositionable. For instance, the brace piece 150 may be positionable on a different location on the grappling dummy 100, for example, on the upper back, the legs 140, 142, or the torso 120. This may allow the grappling dummy 100 to be placed into different positions during training to accommodate the practice of different forms or moves. In another example, the brace piece 150 may remain at a fixed position, but may be changeably angled, lengthened, or shortened, so that the stance, posture, or relative height of the grappling dummy may be selected by the practitioner. For instance, the angle of the brace piece 150 may be changed to make the grappling dummy appear to be lunging forward, rather than standing up straight, which may be useful in training against certain types of attacks.

At least one spring 160-166 is connected to two adjacent portions of the rigid frame 110. Within the scope of this disclosure, this should be understood to mean that the continuous construction of the rigid frame 110 is interrupted in at least one point by one or more springs. The springs may be similar to both joint and muscle, allowing portions of the rigid frame 110 to articulate when force is applied by a practitioner, and returning the portion of the rigid frame 110 to a starting position when force is no longer applied. In this way, the portions of the rigid frame 110 connected by the at least one spring 160-166 are biasably movable.

Any suitable adjacent portions of the rigid frame 110 may be connected by at least one spring. In one example, the head-torso portion may be connected, i.e., the head 112 may be connected to the torso 120 (and/or the shoulder piece 128) by one or more springs 160. In another example, the left arm-torso portion may be connected, i.e., the left arm 130 may be connected to the torso 120 (and/or the shoulder piece 128, as will be understood hereinafter) by one or more springs 162. In another example, the right arm-torso portion may be connected, i.e., the right arm 132 may be connected to the torso 120 by one or more springs 164. In another example, the torso-legs portion may be connected, i.e., the torso 120 may be connected to the legs 140, 142 by one or more springs 166, including by two springs 166. The springs 166 may be located at any point along the torso 120, as is shown in FIG. 1, including at a midpoint, along a lower portion of the torso 120, or at a base point of the torso 120 where the torso 120 and the legs 140, 142 intersect. As will be discussed relative to FIG. 4, below, springs may be placed in any suitable location where articulation is desired, in any suitable number and configuration.

The springs 160-166 may be any suitable type, number, and size. In the example shown in FIG. 1, the springs 160-166 may be coiled steel. In another example, the springs 160-166 may have other shapes, such as torsion, flat, helical, and the like, depending on the requirements of the grappling dummy 100. A combination of spring types may be used in different locations. In one example, the rigid frame 110 may be permanently fastened to the springs 160-166, e.g., by welding or other suitable means. In another example, the springs 160-166 may be removably fastened to one or more portions of the rigid frame 110 which are being articulably joined. In this manner, the springs 160-166 may be selectably removed by the practitioner as will be discussed with reference to FIG. 4, below.

The springs 160-166 may allow the connected portions of the rigid frame 110 to move independently of one another, similar to the way that the features of the human body can move when force is applied to them. Thus, in operation, a practitioner may apply force against the left arm 130, causing the left arm 130 to rotate, twist, or otherwise be displaced in a manner similar to a human arm. When the practitioner ceases applying the force, the left arm 130 may return to its initial position. This may allow the practitioner to train a form or move many times over, learning the precise amount of force, movement, and timing involving in carrying out the form or move. The placement and location of each spring 160-166 may allow each connected human feature a similar degree of independent rotational, torsional, and linear displacement motion when force is applied, then a return to an initial position when force is ceased.

In one example, each spring 160-166 may include a plate 168 at one or both ends of the coil. The plate 168 may be affixed to the spring 160-168 by any suitable method, including welding, adhesive, fastening, and the like. The plate 168 may provide a surface for affixing the pieces of the rigid frame 110 to each spring 168. For example, as shown in FIG. 1, spring 164 includes two plates 168 at either end of the coil. The shoulder piece 128 may be affixed to one plate 168, while the arm pieces 136, 137 may be affixed to the other plate 168. It should be understood that any piece of the rigid frame 110 may be affixed to any spring 160-168 in this manner.

In operation, the grappling dummy 100 may allow practitioners to train across a variety of disciplines. By way of example, and without limitation, moves and forms within the wrestling discipline that may be performed using the grappling dummy 100 include single leg, double leg, ankle pick, fireman's carry, arm drag, hip through, front head lock, half-nelson, under hook, high crotch, and wrist to ankle.

Figure 2:
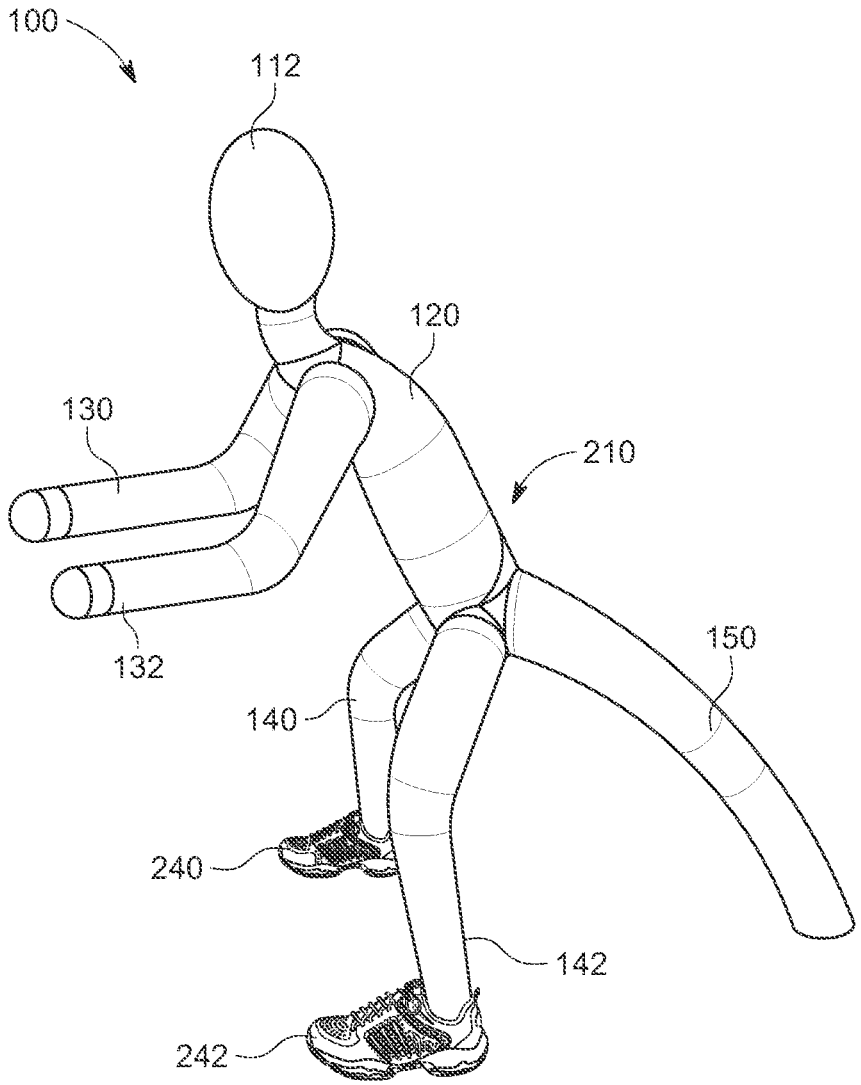
FIG. 2 is a side view illustration of the grappling dummy apparatus, in accordance with the first exemplary embodiment of the present disclosure.

FIG. 2 is a side view illustration of the grappling dummy apparatus 100, in accordance with the first exemplary embodiment of the present disclosure. In the example shown in FIG. 2, the rigid frame 110 of FIG. 1 has been covered by a soft exterior layer 210, which may provide additional volume similar to a human body as well as padding and protection for the practitioner against the rigid frame 110. The soft exterior layer 210 may include any number and type of materials, and may include any number and type of layers. For example, the soft exterior layer 210 may include a soft, insulating layer, such as a foam, textile, polymer gel, ballistics gel, self-healing gel polymer, and the like, along with an outer face layer such as vinyl, silicone, plastic, rubber, and the like. The soft, insulating layer may be shaped to more closely resemble the human features described relative to FIG. 1 and shield the practitioner from the force of the rigid frame 110. The outer face layer may provide a durable covering for the soft, insulating layer. In one example, a single material, such as a self-healing ionic gel polymer, may be used as the soft exterior layer.

In one example, the soft exterior layer 210 may be permanently affixed to the rigid frame 110 during manufacturing. This may be done by any suitable method, including by adhesive, epoxy, heat bonding, friction fit, fasteners, and the like. In another example, the soft exterior layer 210 may be removably affixed to the rigid frame 110. For instance, a portion of the soft exterior layer 210 may be removable by the practitioner for any desired purpose, for example, to replace damaged pieces, to alter the size, shape, weight, appearance, or other characteristics of a portion of the grappling dummy 100, or to alter a portion of the rigid frame 110.

The soft exterior layer 210 may cover at least a portion of the rigid frame 110. In the example shown in FIG. 2, all of the human features are covered, including the head 112, torso 120, arms 130, 132, and legs 140, 142. The brace piece 150 may also be covered.

In one example, additional aesthetic features may be added to the soft exterior layer 210 to increase the human likeness of the grappling dummy 100. For instance, shoes 240, 242 may be added to the feet portions of the legs 140, 142. In other examples, the soft exterior layer 210 may include facial features, hair, hands, clothing, skin, or any number of other characteristics.

Figure 3:
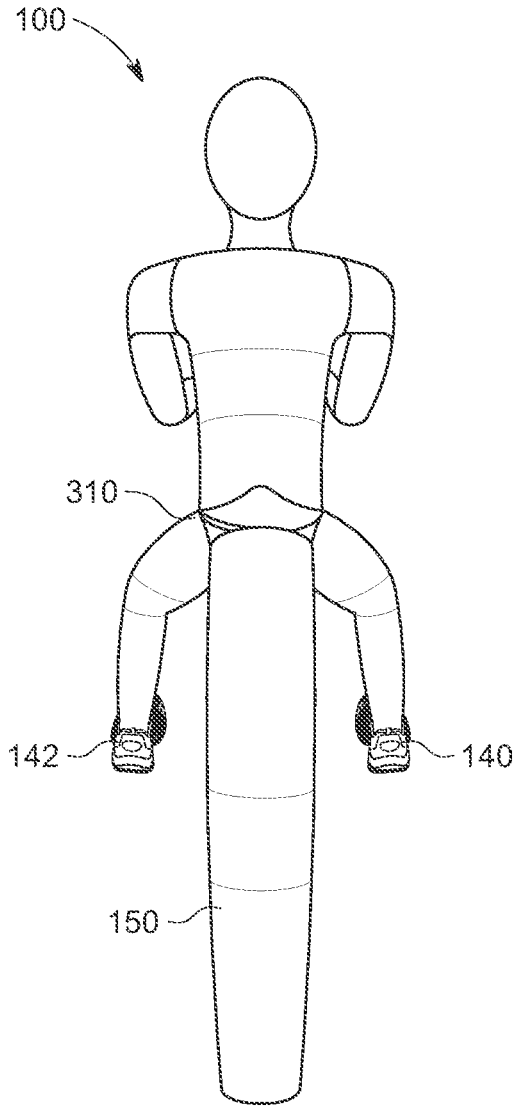
FIG. 3 is a rear view illustration of the grappling dummy apparatus, in accordance with the first exemplary embodiment of the present disclosure.

FIG. 3 is a rear view illustration of the grappling dummy apparatus 100, in accordance with the first exemplary embodiment of the present disclosure. FIG. 3 illustrates the downward curvature of the brace piece 150 from its connection point at the bottom of the torso portion 310 of the rigid frame 110 and extending to the level on which the legs 140, 142 are positioned. As shown in FIGS. 2-3, the brace piece 150 may extend away from the torso 120 by at least the same distance between the "feet" of the legs 140, 142. In one example, the brace piece 150 may extend away from the torso 120 further than the distance between the feet of the legs 140, 142.

Figure 4:
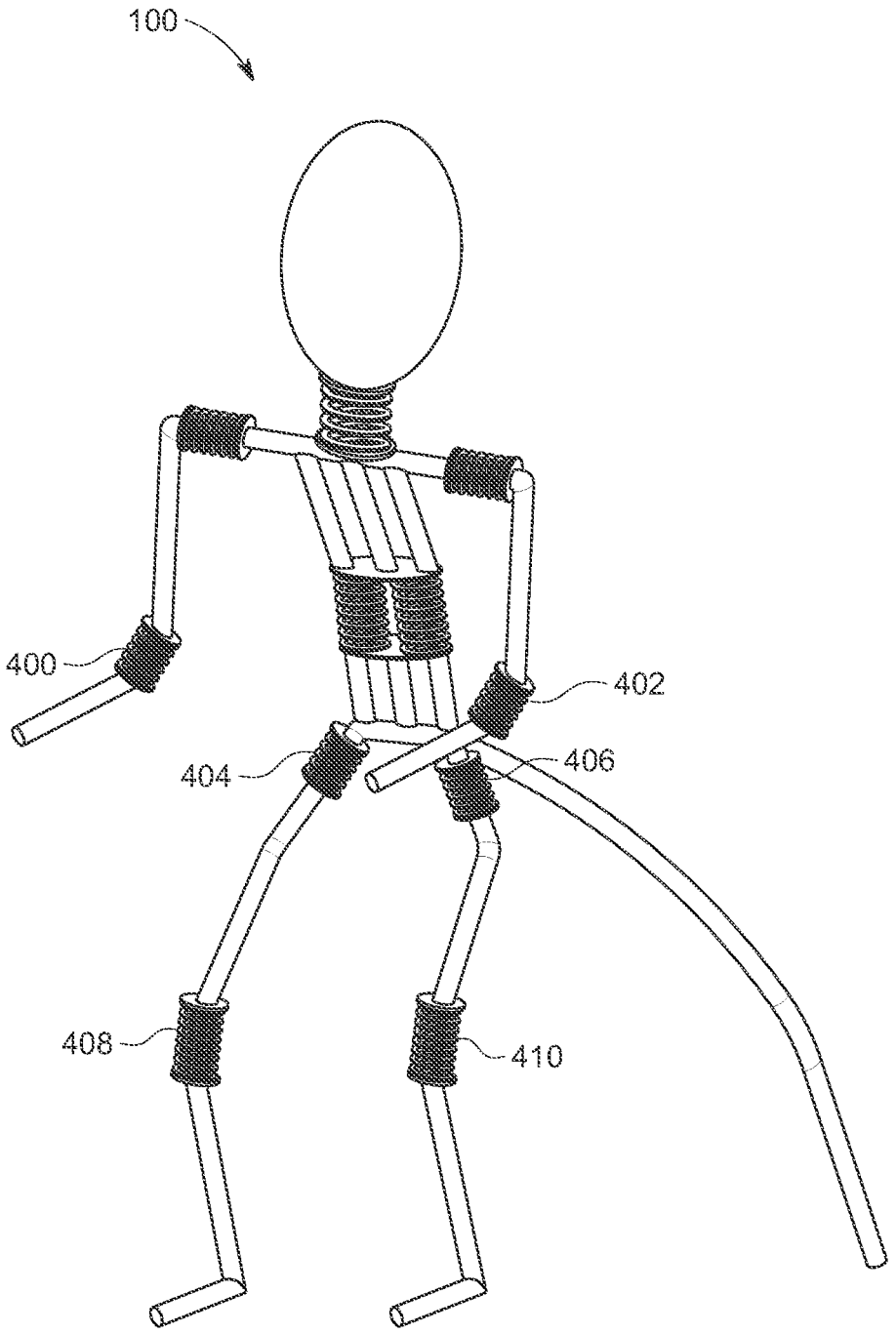
FIG. 4 is a diagrammatic illustration of the grappling dummy apparatus showing additional springs, in accordance with the first exemplary embodiment of the present disclosure.

FIG. 4 is a diagrammatic illustration of the grappling dummy apparatus 100 showing additional springs 400-410, in accordance with the first exemplary embodiment of the present disclosure. For clarity in the illustration, aspects of the grappling dummy 100 which have been previously identified by reference characters relative to FIGS. 1-3 are not labelled; however, FIG. 4 may be understood with reference to FIGS. 1-3, above. Springs may be located wherever the practitioner desires articulation of any part of the rigid frame 110. For example, springs 400, 402 may be located on the left and right arms 130, 132, respectively, where elbows would typically be found on a human body, thus enabling the distal aspects of the arms 130, 132 to articulate independent of the proximal aspects. In another example, springs 404, 406 may be located just at the base of the legs 140, 142, where hips would typically be found on a human body, thus enabling the proximal aspects of the legs and the torso 120 to articulate independent of the distal aspects. In another example, springs 408, 410 may be located partially along the legs 140, 142, where knees would typically be found on a human body, thus enabling the distal aspects of the legs 140, 142 to articulate independent of the proximal aspects.

In one example, all springs 160-166, 400-410 may have the same spring force, i.e., strength in opposition and return to initial position. In another example, certain springs may have lesser spring force than others, while certain springs may have greater spring force than others. This may be selected to simulate the strength of the various joints and features of the human body in one example. In another example, certain springs may be replaceable by the practitioner as desired. For instance, the practitioner may desire to train arm forms or moves and may increase the spring force in those springs 162, 164, 400, 402 relative to their initial strengths in order to develop their technique. Or the practitioner may desire to set a lower spring strength when learning a new form or move in order to make the execution of that form or move easier initially. In another example, the practitioner may desire to practice forms or moves using the practitioner's left side or right side, and may adjust the spring force on either the left side or right side of the grappling dummy 100 in order to increase or decrease the difficulty of performing moves against that side. For instance, a practitioner wanting to focus on training right side forms may increase the spring force of springs on the left side of the grappling dummy 100 in order to make successful moves on the left side more likely. In one example, every spring 160-166, 400-410 may be customizable and selectable in strength by the practitioner, and may be replaced at the practitioner's discretion.

Figure 5:
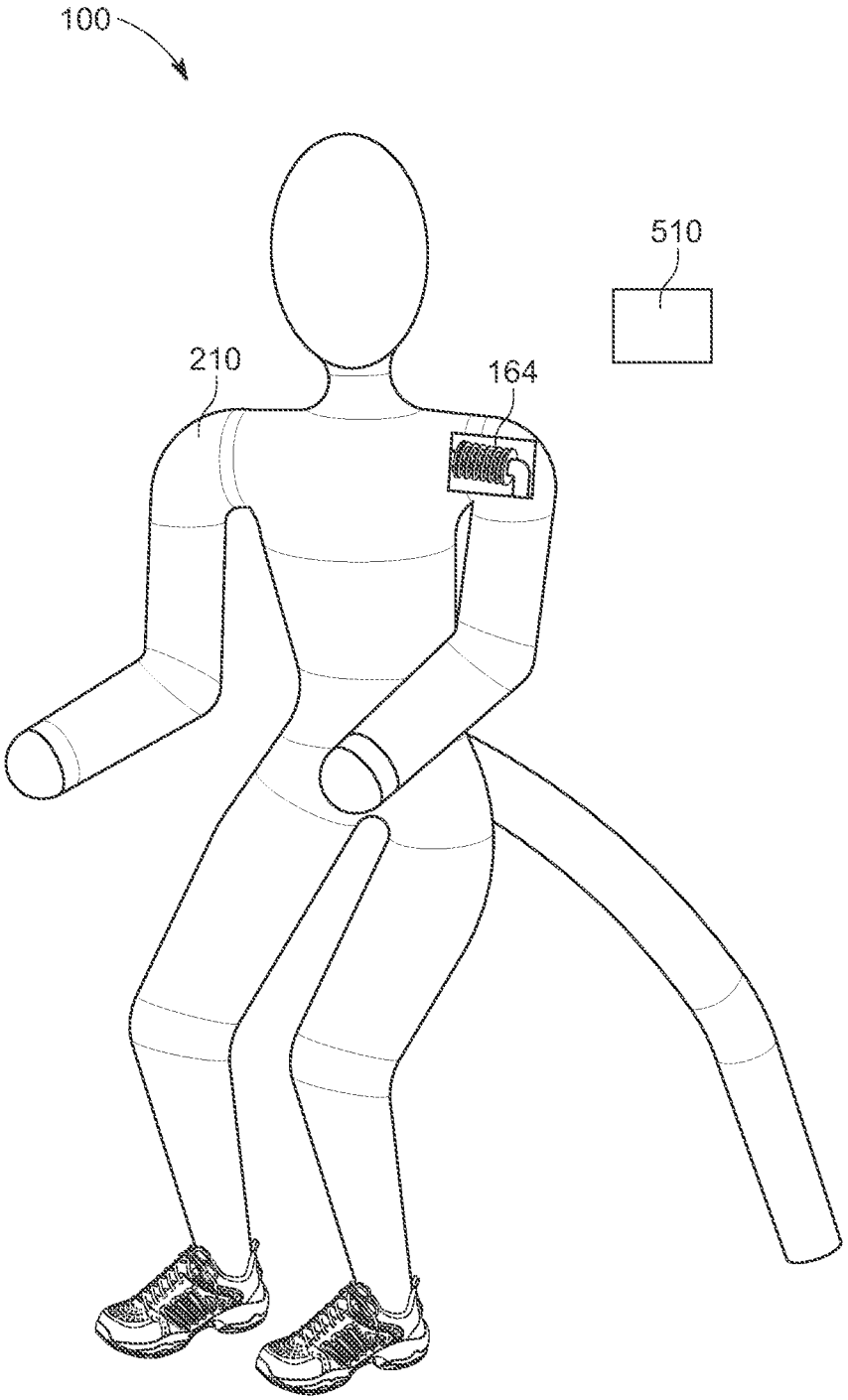
FIG. 5 is a diagrammatic illustration of the grappling dummy apparatus showing a removable portion of the exterior layer, in accordance with the first exemplary embodiment of the present disclosure.

FIG. 5 is a diagrammatic illustration of the grappling dummy apparatus 100 showing a removable portion 510 of the exterior layer 210, in accordance with the first exemplary embodiment of the present disclosure. In one example, one or more portions of the soft exterior layer 210 may be removable by the practitioner. In the example shown in FIG. 5, a small removable portion 510 corresponds with the location of a spring 164. By removing the removable portion 510, the practitioner may access the spring 164 and may removably select the spring force as described relative to FIG. 4, above. In another example, larger portions of the soft exterior layer may be removable by the practitioner. For instance, an entire portion of the right or left arm 130, 132 may be removable in order to gain access to the rigid frame 110 beneath the soft exterior layer 210 there. In another example, the entire exterior layer 210 may be removable by section or by undoing a zipper, series of clasps, snaps, hooks, buttons, and the like.

FIGS. 6A-6D are diagrammatic illustrations showing the points of motion of the grappling dummy apparatus 100, in accordance with the first exemplary embodiment of the present disclosure. FIGS. 6A-6D may be understood with reference to FIGS. 1-5, above. The arrows illustrated within FIGS. 6A-6D are meant as representations of motion and are not intended to illustrate the complete range, axes, directions, or exact types of motion which the grappling dummy 100 may undergo. These drawings are intended to provide illustrative examples without limitation.

Figure 6A:
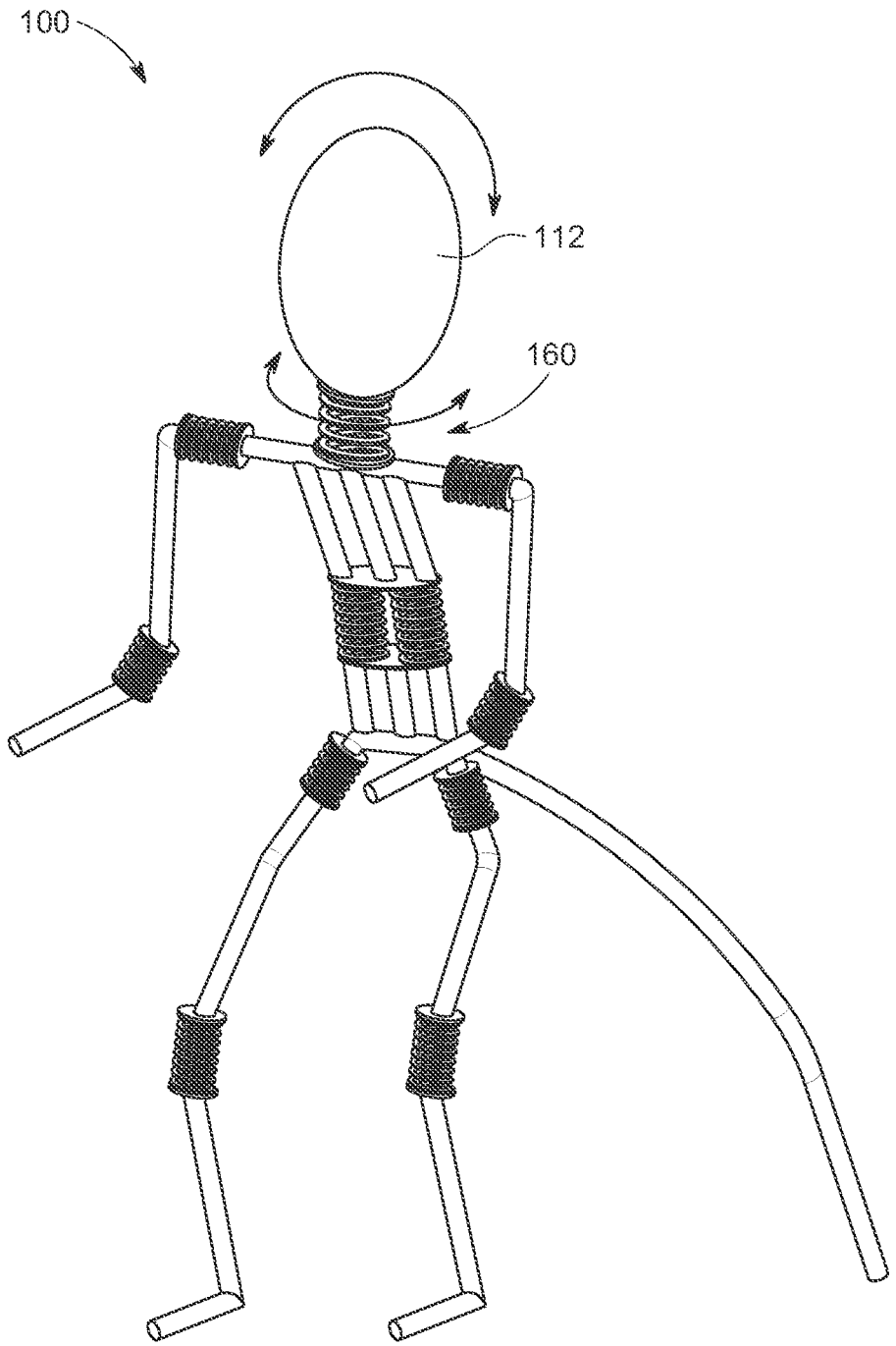
FIGS. 6A-6D are diagrammatic illustrations showing the points of motion of the grappling dummy apparatus, in accordance with the first exemplary embodiment of the present disclosure.

FIG. 6A illustrates the exemplary motion of the head 112 using one or more springs 160. The head 112 may move forward, backward, left or right, and may also twist and rotate by the springs 160.

Figure 6B:
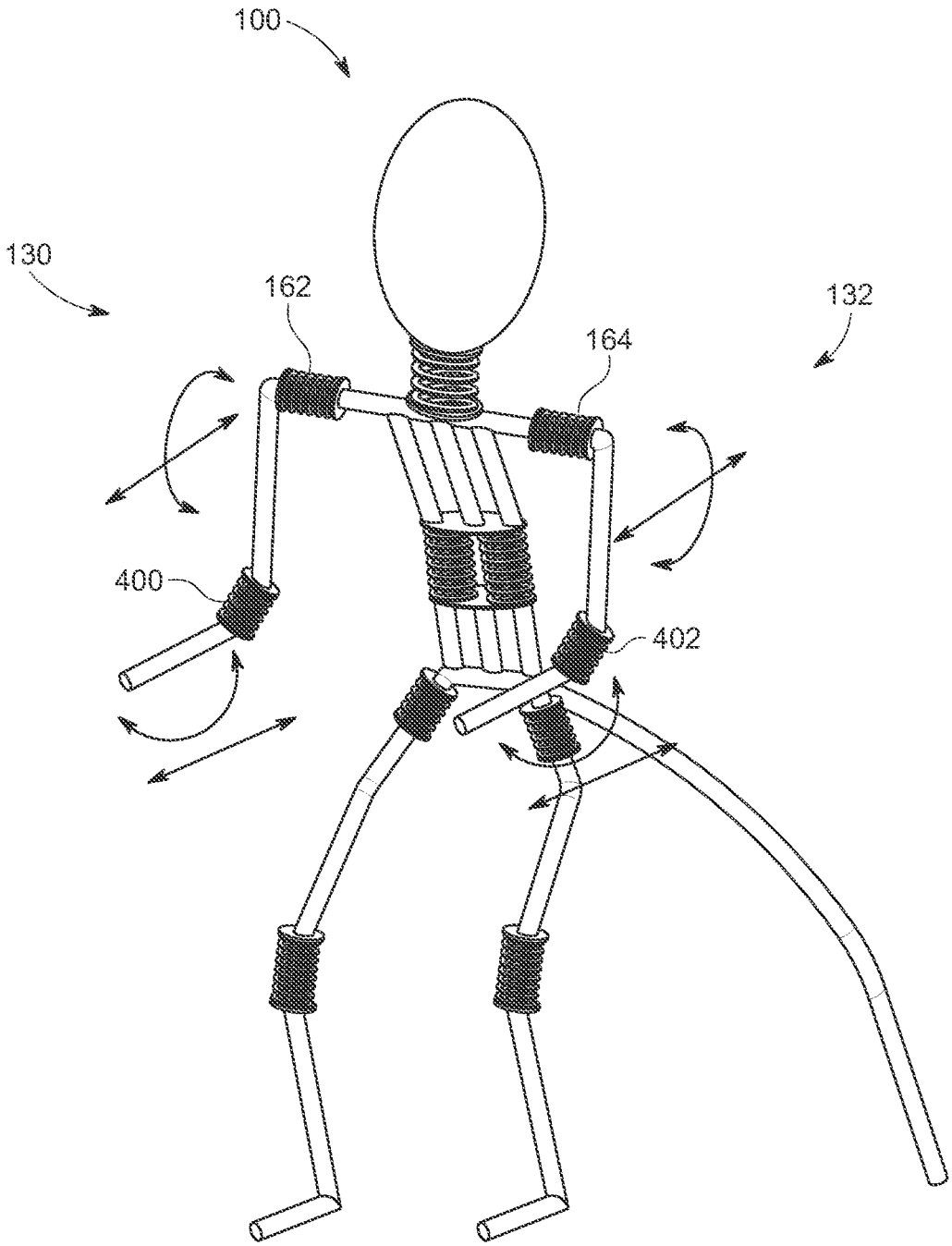

FIG. 6B illustrates the exemplary motion of the arms 130, 132 using one or more springs 162, 164, 400, 402. Reference characters are not shown for the torso 120 or the shoulder piece 128 for clarity in the illustration, but should be understood with reference to FIG. 1. At the junction between the shoulder piece 128 and the left and right arms 130, 132, the left and right arms 130, 132 may extend away from the torso 120 in all rotational directions, may twist and rotate about the junction, and may be laterally translated. The same is true of the left and right arms 130, 132 at the junction of the springs 400, 402.

Figure 6C:
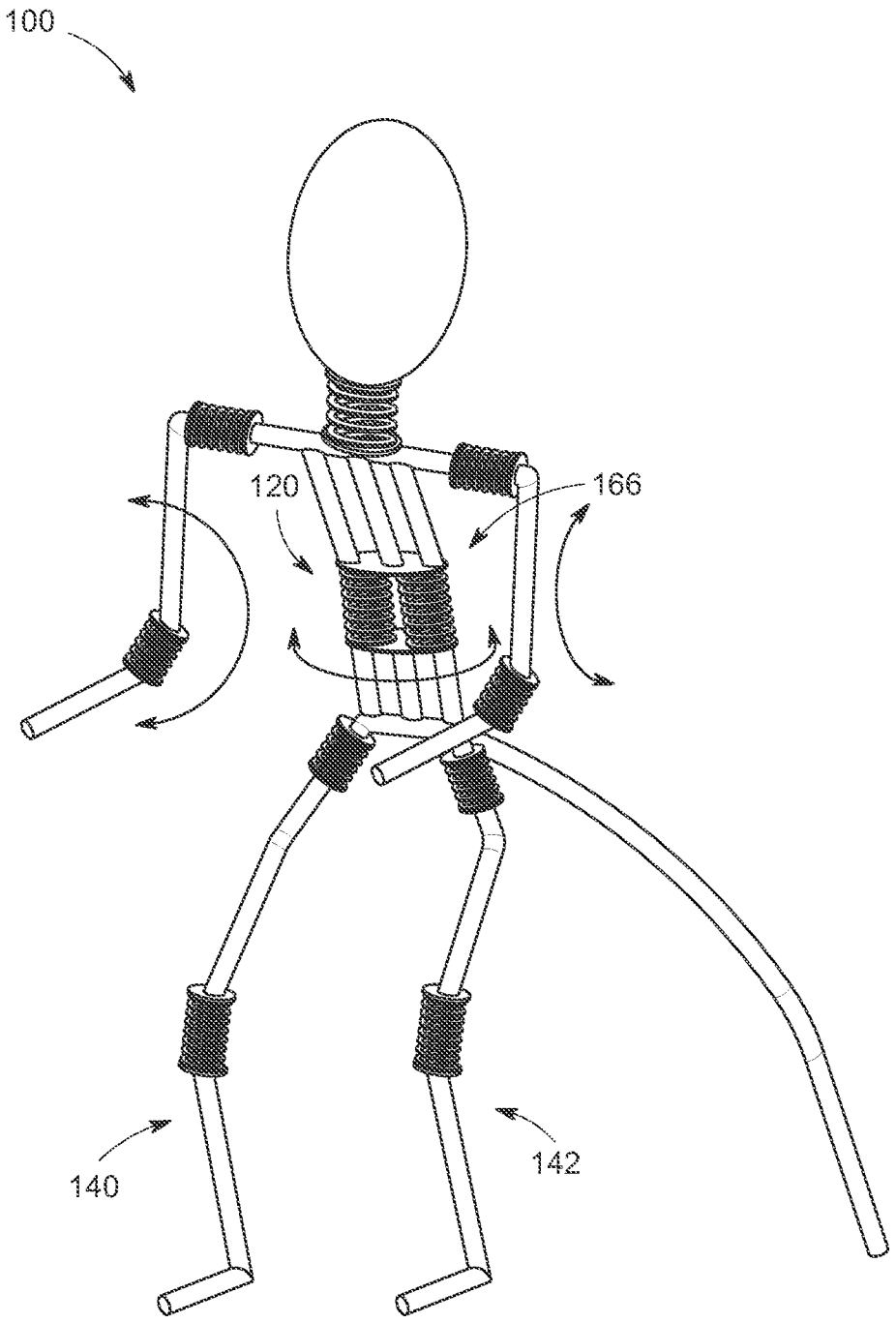

FIG. 6C illustrates the exemplary motion of the torso 120 using one or more springs 166. At the junction between the torso 120 and the legs 140, 142, the torso may rotate forward, backward, left or right, and may also twist and rotate by the springs 166.

Figure 6D:
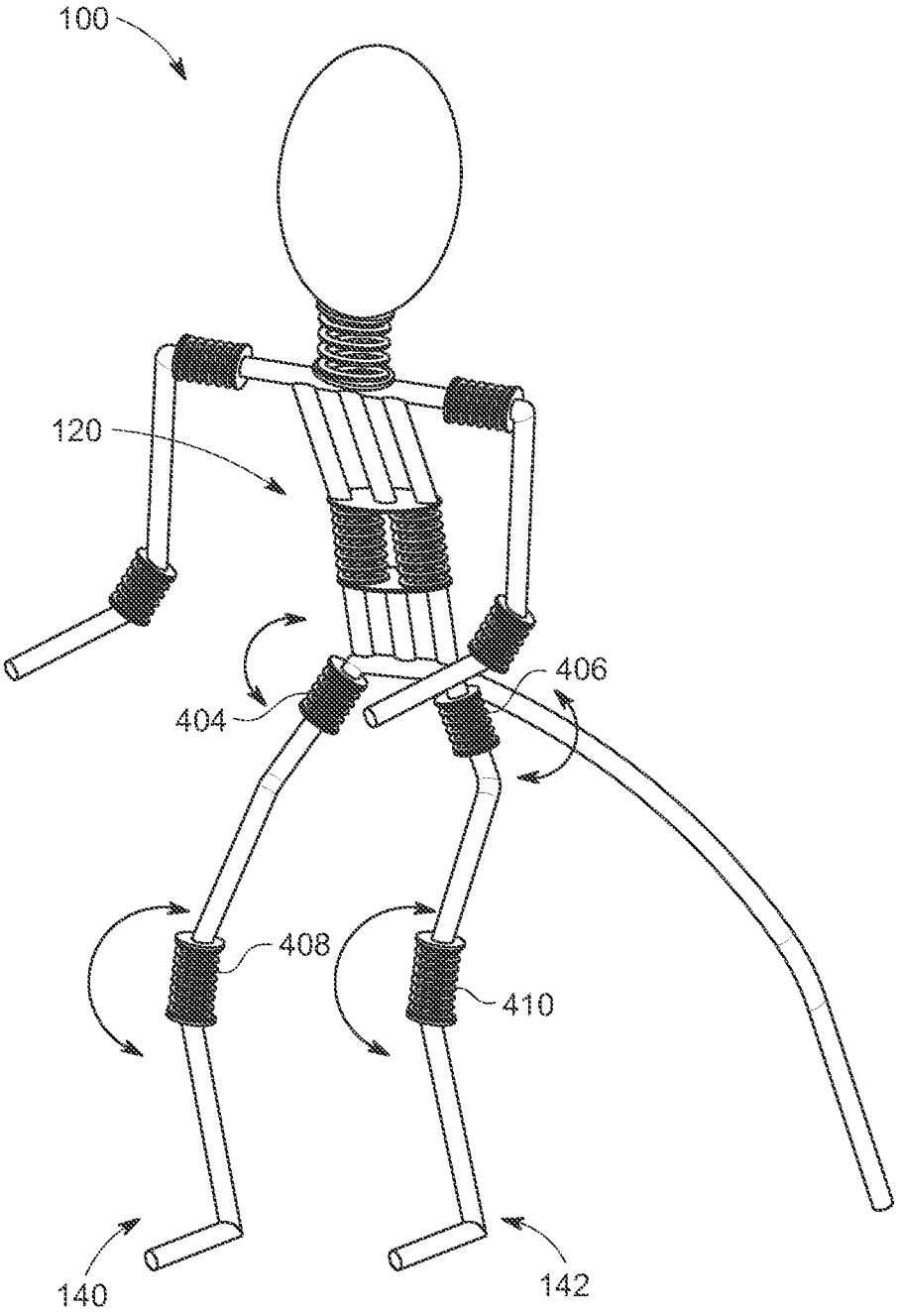

FIG. 6D illustrates the exemplary motion of the legs 140, 142 using one or more springs 404, 406, 408, 410. At the junction between the torso 120 and the legs 140,142 (i.e., the "hips"), the legs 140, 142 may rotate forward, backward, left or right, and may also twist and rotate by the springs 404, 406. At the junction in the middle portion of the legs 140, 142, the proximal aspect of the legs 140, 142 may rotate forward, backward, left or right, and may also twist and rotate by the springs 408, 410. In one example, the particular amount of movement and rotation may be selected by the practitioner to correspond closely to human features. In other words, the springs 408, 410 may be selected to allow a range of rotation between the aspects of each leg 140, 142 respectively, as a knee would, but not to allow twisting about the axis of the spring, as a knee would not.

Figure 7:
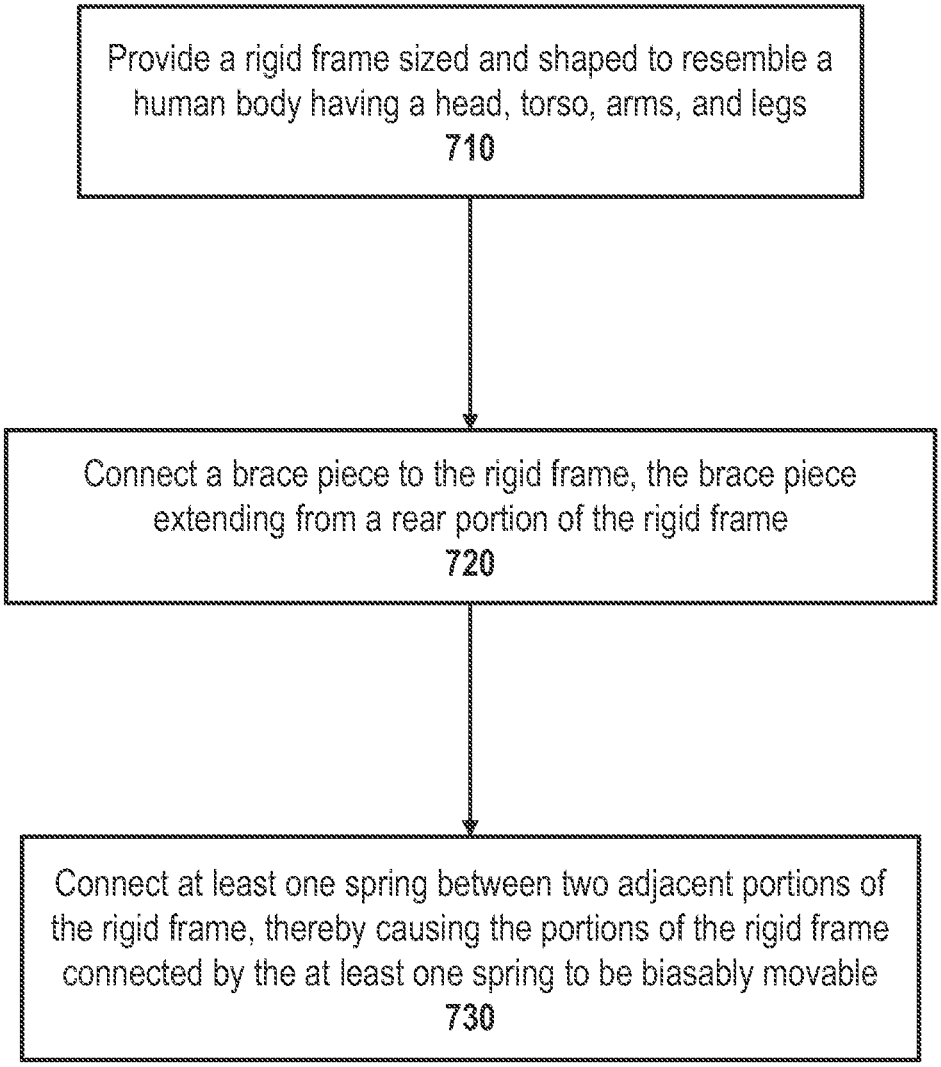
FIG. 7 is a flowchart illustrating a method of making a grappling dummy, in accordance with the first exemplary embodiment of the present disclosure.

FIG. 7 is a flowchart 700 illustrating a method of making a grappling dummy, in accordance with the first exemplary embodiment of the present disclosure. The method may be understood with reference to FIGS. 1-6D, above. It should be noted that any process descriptions or blocks in flow charts should be understood as representing modules, segments, or steps that include one or more instructions for implementing specific logical functions in the process, and alternate implementations are included within the scope of the present disclosure in which functions may be executed out of order from that shown or discussed, including substantially concurrently or in reverse order, depending on the functionality involved, as would be understood by those reasonably skilled in the art of the present disclosure.

Step 710 includes providing a rigid frame sized and shaped to resemble a human body having a head, torso, arms, and legs. In one example, the rigid frame may include additional human features such as hands, feet, shoulders, buttocks, muscle features, genitals, facial features, and the like. The rigid frame may be made from any suitable material and may be manufactured using any suitable process. In one example, the rigid frame may include only a portion of the human body features, such as features of the upper body (i.e., the head, arms, and torso), features of the lower body (i.e., the torso and legs), or any combination thereof.

In one example, a soft exterior layer may be provided over the rigid frame in order to insulate the practitioner from the rigid frame, provide more humanlike volume, and create more humanlike aesthetic. Any of the human features described above may be created by the soft exterior layer.

Step 720 includes connecting a brace piece to the rigid frame, the brace piece extending from a rear portion of the rigid frame. The brace piece may be made from any suitable material, including the same material as the rigid frame. In one example, the brace piece may be rigid, like the rigid frame. In another example, the brace piece may be flexible or semi-flexible. The brace piece may be connected to the rigid frame by any suitable means, including welding, adhesive, fastening, monolithic forming, and the like. In one example, the brace piece may be removably connected to the rigid frame. The brace piece may be connectable at a plurality of locations, enabling the grappling dummy to be braced at a plurality of angles or positions during use. In one example, the brace piece may be formed with a downward curve and may be positioned to end at a surface level in order to provide a third point of stability for the grappling dummy.

Step 730 includes connecting at least one spring between two adjacent portions of the rigid frame, thereby causing the portions of the rigid frame connected by the at least one spring to be biasably movable. The at least one spring may be located between the adjacent portions of the rigid frame so that, in operation, the rigid frame is movable by the practitioner. In one example, a first portion of the rigid frame may be connected to a first end or first portion of the spring, and a second portion of the rigid frame may be connected to a second end or second portion of the spring, such that the first and second portions of the rigid frame are in mechanical connection by the at least one spring. When force is applied to the first or second portion of the rigid frame, that portion may move as governed by the properties of the at least one spring. When force is no longer applied, that portion may return to its initial place. The at least one spring may be selectably removable by the practitioner according to the practitioner's desires.

It should be emphasized that the above-described embodiments of the present disclosure, particularly, any "preferred" embodiments, are merely possible examples of implementations, merely set forth for a clear understanding of the principles of the disclosure. Many variations and modifications may be made to the above-described embodiment(s) of the disclosure without departing substantially from the spirit and principles of the disclosure. All such modifications and variations are intended to be included herein within the scope of this disclosure and the present disclosure and protected by the following claims.

What is claimed is:

1. A grappling dummy apparatus comprising:

a rigid frame sized and shaped to resemble a human body having portions comprising a head, torso, arms, and legs;

a brace piece connected to the rigid frame at a bottom of the torso portion of the rigid frame and extending from a rear portion of the rigid frame, wherein the brace piece has a downward sloping arcuate shape ending in a point at a level of the legs portion of the rigid frame, whereby the point and the legs portion of the rigid frame stabilize the grappling dummy apparatus in an upright position during operation; and at least one spring connecting two adjacent portions of the rigid frame, wherein the portions of the rigid frame connected by the at least one spring are biasably movable.

2. The grappling dummy apparatus of claim 1, further comprising a soft exterior layer covering at least a portion of the rigid frame, brace piece, and at least one spring.

3. The grappling dummy apparatus of claim 2, wherein the soft exterior layer is shaped to resemble a human head, torso, arms, and legs.

4. The grappling dummy apparatus of claim 2, wherein at least a portion of the soft exterior layer is replaceably removable at a location of the at least one spring.

5. The grappling dummy apparatus of claim 1, wherein the rigid frame comprises a rigid interior layer and a soft exterior layer.

6. The grappling dummy apparatus of claim 1, wherein the portions of the rigid frame connected by the at least one spring are selected from the set of: head-torso, left arm-torso, right arm-torso, torso-legs, left knee, and right knee.

7. The grappling dummy apparatus of claim 1, wherein the torso and leg portions of the rigid frame are connected by two springs.

8. The grappling dummy apparatus of claim 1, comprising a plurality of springs connecting adjacent portions of the rigid frame, wherein at least one spring has a different spring force from the other of the plurality of springs.

9. The grappling dummy apparatus of claim 1, wherein the at least one spring is replaceable, and wherein a desired spring force is selectable by placing a spring having the desired spring force in connection with the rigid frame.

10. A method of making a grappling dummy, comprising the following steps:

providing a rigid frame sized and shaped to resemble a human body having portions comprising a head, torso, arms, and legs;

connecting a brace piece to the rigid frame at a bottom of the torso portion of the rigid frame, the brace piece extending from a rear portion of the rigid frame, wherein the brace piece has a downward sloping arcuate shape ending in a point at a level of the legs portion of the rigid frame, whereby the point and the legs portion of the rigid frame stabilize the grappling dummy in an upright position during operation;

connecting at least one spring between two adjacent portions of the rigid frame, thereby causing the portions of the rigid frame connected by the at least one spring to be biasably movable.

11. The method of claim 10, further comprising the step of covering at least a portion of the rigid frame, brace piece, and at least one spring with a soft exterior layer.

12. The method of claim 11, wherein the soft exterior layer is shaped to resemble a human head, torso, arms, and legs.

13. The method of claim 11, wherein at least a portion of the soft exterior layer is replaceably removable at a location of the at least one spring.

14. The method of claim 10, wherein the rigid frame comprises a rigid interior layer and a soft exterior layer.

15. The method of claim 10, wherein the portions of the rigid frame connected by the at least one spring are selected from the set of: head-torso, left arm-torso, right arm-torso, torso-legs, left knee, and right knee.

16. The method of claim 10, wherein the torso and leg portions of the rigid frame are connected by two springs.

17. The method of claim 10, comprising a plurality of springs connecting adjacent portions of the rigid frame, wherein at least one spring has a different spring force from the other of the plurality of springs.

18. The method of claim 10, wherein the at least one spring is replaceable, and wherein a desired spring force is selectable by placing a spring having the desired spring force in connection with the rigid frame.

* * * * *